US005499861A

United States Patent [19]

Locher

[11] Patent Number: 5,499,861

[45] Date of Patent: Mar. 19, 1996

[54] CHAIR, IN PARTICULAR OFFICE CHAIR

[75] Inventor: Hermann Locher, Schwanden, Switzerland

[73] Assignee: Giroflex-Entwicklungs-AG, Koblenz, Switzerland

[21] Appl. No.: 91,673

[22] Filed: Jul. 14, 1993

[30] Foreign Application Priority Data

Jul. 16, 1992 [CH] Switzerland ..... CH02251/92

[51] Int. Cl.[6] ..... A47C 3/026

[52] U.S. Cl. ..... 297/301.2; 297/317; 297/322

[58] Field of Search ..... 297/301, 302, 297/304, 317, 318, 322

[56] References Cited

U.S. PATENT DOCUMENTS

| | | | |
|---|---|---|---|
| 4,390,206 | 6/1983 | Faiks et al. | 297/304 |
| 4,776,633 | 10/1988 | Knoblock et al. | 297/301 |
| 5,080,434 | 1/1992 | Locher | 297/301 |
| 5,114,211 | 5/1992 | Desanta | 297/304 |

FOREIGN PATENT DOCUMENTS

| | | |
|---|---|---|
| 0010990 | 5/1980 | European Pat. Off. . |
| 0485686 | 5/1992 | European Pat. Off. . |
| 2195238 | 4/1988 | United Kingdom . |

*Primary Examiner*—Richard A. Bertsch
*Assistant Examiner*—William Wicker
*Attorney, Agent, or Firm*—Cushman Darby & Cushman

[57] ABSTRACT

The invention relates to a load-bearing frame for a chair, in particular for an office chair, which can be adjusted in terms of its height and inclination and comprises a seat carrier (1), a backrest carrier (2), a load-bearing and pivoting device (80) and a standing column (5). By means of struts (46, 32) arranged on the knee side and backrest side and supported on a spindle body, the seat carrier and backrest carrier (1, 2) are mounted on a spindle body such that they can pivot about a horizontal axis (X), oriented transversely to the seat direction, against the restoring force at least of a first spring element (40, 40'), and, in any position, can be fixed, and released again, by a second spring element. On the standing column (5) there is arranged a retaining device (10) through which the spindle body passes in the horizontal direction and on which a bracing element (20), by means of which the restoring force of the first spring elements (40, 40') can be adjusted, is mounted such that it can pivot about a bolt (15).

15 Claims, 7 Drawing Sheets

CHAIR, IN PARTICULAR OFFICE CHAIR

BACKGROUND OF THE INVENTION

1. Field of the Invention

The invention relates to a load-bearing frame for a chair, in particular for an office chair which can be adjusted in terms of its height and inclination, comprising a standing column, a load-bearing and pivoting device arranged thereon, a seat carrier and a backrest carrier, the seat carrier and the backrest carrier being mounted on the load-bearing and pivoting device by means of struts arranged on the knee side and backrest side of a spindle body, and it being possible to pivot the said carriers backwards about the horizontal axis of the load-bearing and pivoting device against the restoring force at least of a first spring element, and to fix them in any position, and release them again by a second spring element arranged parallel or transversely to the axis.

2. Description of the Prior Art

EP-A 0 485 868 discloses an office chair which can be adjusted in terms of its height and inclination and comprises a load-bearing frame essentially constituted by a seat carrier, a backrest carrier and a first and a second guiding rod arrangement, which frame is mounted on a load-bearing body arranged and fastened on a standing column and, together with the seat carrier and backrest carrier, can be inclined backwards against the restoring force of a rotation and torsion bar, and can be fixed in any position by a pneumatic spring which can be locked and released again.

The object of the invention is to design and improve a chair of the generic type such that, while maintaining the ergonomic requirements dependent on the user, no transverse forces are transmitted to the spring element compensating for the backwards and forwards pivoting movement and, in addition, an effortless, synchronised movement progression is ensured.

SUMMARY OF THE INVENTION

The chair according to the invention is characterised by a retaining device, which is arranged at the upper end of the standing column and through which the spindle body passes, and two helical springs which are oriented on both sides in the longitudinal direction of the axis, are arranged between the lateral struts and the retaining device, are mounted on the spindle body and, in order to adjust the spring restoring force, are held, by one spring end piece, on a bracing element mounted on the retaining device and, by the other end, on a bearing element which is operatively connected to the backrest carrier.

Further features of the invention are given in the following description in conjunction with the drawing and the individual patent claims.

BRIEF DESCRIPTION OF THE DRAWINGS

In the following, preferred exemplary embodiments of the invention are described in more detail by means of the drawing, in which.

DESCRIPTION OF PREFERRED EMBODIMENTS

Figure 1:
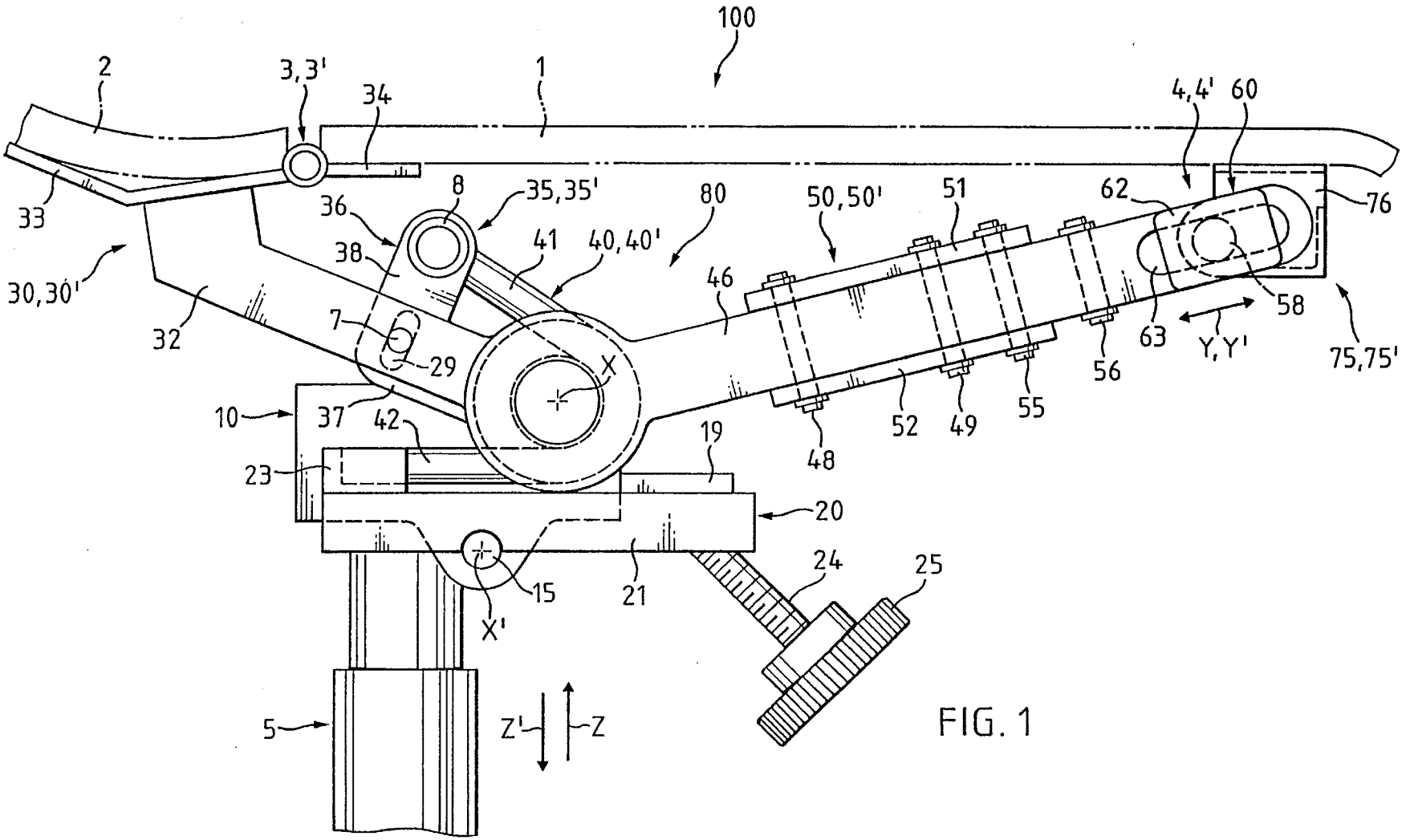
FIG. 1 shows a side view of a first exemplary embodiment of a load-bearing frame, arranged on a height-adjustable standing column, for an office chair.

FIG. 1 shows, as a first exemplary embodiment, a side view of a load-bearing frame, designated as a whole by 100, for a chair, in particular for an office chair which can be adjusted in terms of its height and inclination and can be locked in any height-dependent and/or inclination-dependent position. The load-bearing frame 100 essentially comprises a load-bearing and pivoting device 80 for a seat carrier 1 and a backrest carrier 2 which is operatively connected to the seat carrier via a first articulation point 3, 3'. The backrest carrier 2 is supported on the load-bearing and pivoting device 80 via a bearing device 30, 30' and is mounted such that it can pivot about a horizontal axis X of the load-bearing and pivoting device. The load-bearing and pivoting device 80, which is operatively connected to two spring elements 40, 40' arranged transversely to the seat direction, is fastened on a schematically, and only partially, represented standing column 5 by means of a correspondingly designed retaining device 10.

A spring element which is provided for the height adjustment, oriented in arrow direction Z and Z', of the load-bearing frame 100 and is designed preferably as a pneumatic spring (not shown) is arranged in the partially represented standing column 5. A bottom frame known per se and designed as a 5-pronged-star lower part is arranged in the lower region of the standing column 5. For mobility of the office chair, the bottom frame (not shown) is preferably provided with casters.

The retaining device 10 and a bracing element 20 are, as shown in FIG. 1, arranged in the upper region of the standing column 5. The restoring force of both spring elements 40, 40' can be adjusted by means of the bracing element 20. The bracing element 20 is mounted on a pin 15 of the retaining device 10, such that it can pivot about an axis X' of the pin 15, and can be adjusted relative to the retaining device 10 by means of a threaded spindle 24. The axis X' is arranged in parallel with, and at a distance from, the axis X of the load-bearing and pivoting device 80. The threaded spindle 24 which can be actuated by means of a gripping piece 25 is supported, in a manner not shown in any more detail, on a stop piece 19 of the retaining device 10. The retaining device 10 and the bracing element 20 are described later in detail in conjunction with FIGS. 5 to 8.

Figure 2:
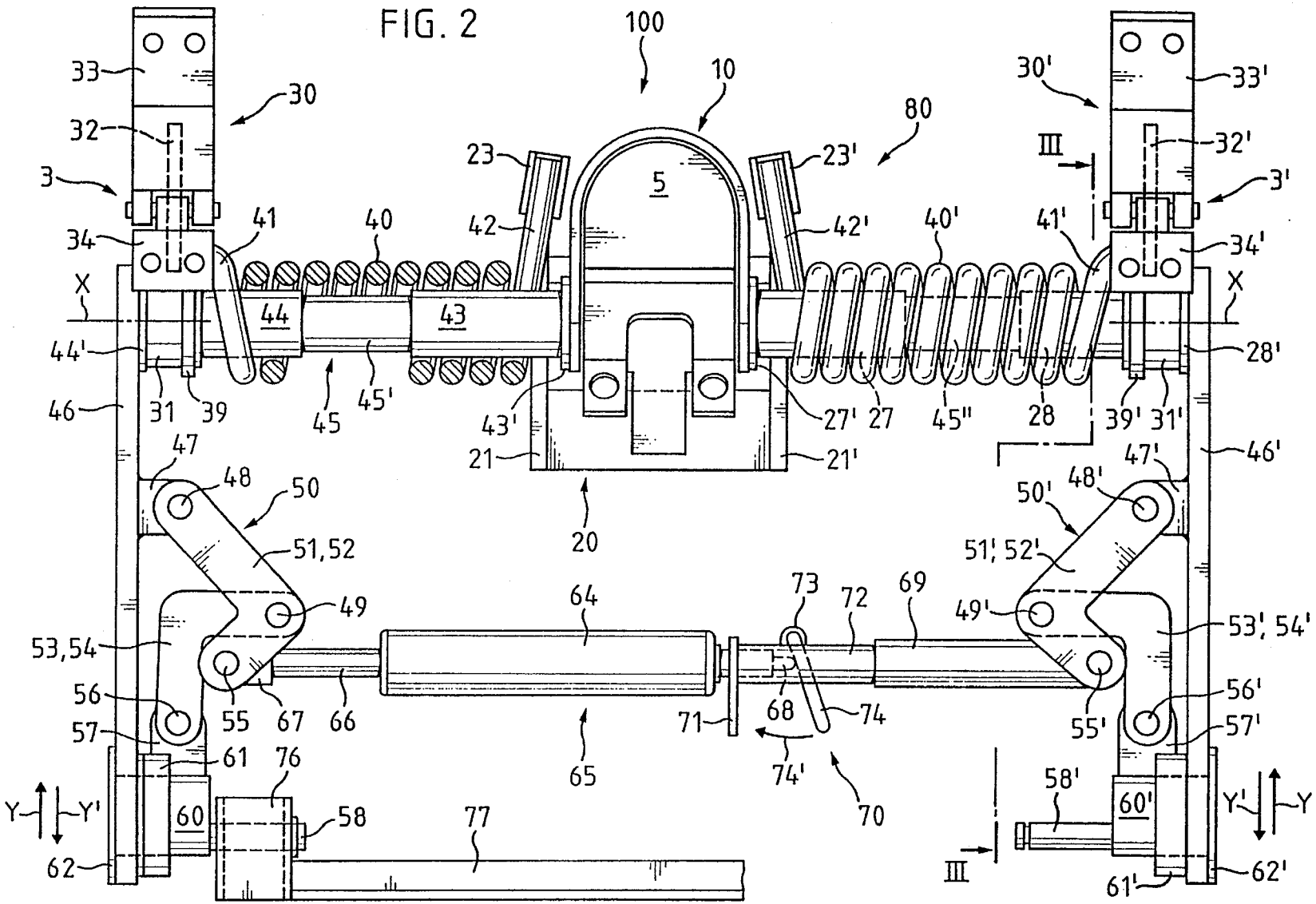
FIG. 2 shows the load-bearing frame according to FIG. 1, represented in plan view.

As shown in FIG. 1, the retaining device 10 arranged on the standing column 5 is designed for receiving and mounting the load-bearing and pivoting device 80 oriented transversely to the seat direction. On the load-bearing and pivoting device 80, the backrest carrier 2 and the seat carrier 1, articulated thereon, are supported approximately in the backrest-side region via the first bearing device 30 and 30'. The bearing device 30 comprises a first tab 33, fastened on the backrest carrier 2 with the aid of means (not shown), and a second tab 34 which is connected in an articulated manner to the first and is fastened on the seat carrier 1 with the aid of means (not shown). One bearing device 30 is supported, via a lever 32 arranged and fastened on the first tab 33, on a bushing 31 mounted on the load-bearing and pivoting device 80 (FIG. 2). The other bearing device 30' (FIG. 2) is designed analogously and comprises the parts 31', 32', 33' and 34'. In the knee-side region, the seat carrier 1 is fastened on second bearing devices 75, 75'. The bearing devices 75, 75' essentially form in each case a second articulation point 4, 4' and are supported on the load-bearing and pivoting device 80 by means of articulated struts 46 and 46'.

The load-bearing and pivoting device 80 has the horizontal axis X which is oriented transversely to the seat direction and about which the individual elements operatively connected thereto can be pivoted against the restoring force of the spring elements 40, 40' for a corresponding movement of the seat carrier 1 and of the backrest carrier 2. As already mentioned, the restoring force of the two spring elements 40, 40' designed as helical springs can be adjusted by means of the bracing element 20.

The pivoting movement of the seat carrier 1 and the backrest carrier 2 by means of the individual elements can, however, only take place after a locking device (not shown in any more detail in FIG. 1) has been unlocked. The locking device and a first and second lever system 50, 50', partially shown in FIG. 1, are further described later by means of FIG. 2.

As shown in FIG. 1, one of the spring elements 40 visible here is arranged, by one end 41, in a retaining device 35 and, by the other end 42, on a shoe-shaped retaining piece 23 of the bracing element 20. The retaining device 35 is, on the one hand, mounted on the load-bearing and pivoting device 80 by means of a toggle lever 36 and is, on the other hand, operatively connected to the lever 32 of the bearing device 30. The arrangement and fastening of the other spring element 40' on the bracing element 20 and the associated second retaining device 35' are analogous.

In FIG. 2, the load-bearing frame 100 of the first exemplary embodiment (without seat carrier and backrest carrier 1, 2) with the load-bearing and pivoting device 80 is shown in plan view, and the retaining device 10, arranged on the schematically represented standing column 5, with the bracing element 20 are shown. A spindle body 45 essentially forming the horizontal axis X is arranged and mounted in the retaining device 10, the spindle body 45 being subdivided preferably into two spindle-body part-pieces 45' and 45". The strut 46, 46' is respectively arranged and fastened at the outer ends of the spindle bodies 45', 45". The retaining device 10 and the two spindle bodies 45', 45" and the two struts 46, 46' are fixed in terms of rotation, in a manner not shown in any more detail, e.g. are connected to one another in a positively locking manner and together form a structural unit.

Between the retaining device 10 and the two struts 46, 46' arranged at a distance therefrom there are arranged the two helical springs 40, 40', through each of which the associated spindle bodies 45', 45" pass and which are mounted on bushings 43, 44 and 27, 28 arranged at a distance from one another. The bushings 43, 44 and 27, 28 mounted on the two spindle bodies 45', 45" are each provided with a formed-on flange collar 43', 44' and 27', 28' bearing on the two side walls of the retaining device 10 and on the struts 46, 46'.

The bushings 27, 28 and 43, 44 arranged correspondingly on the spindle bodies 45', 45" for mounting the helical springs 40, 40' are produced preferably from suitable plastic with good sliding properties, for example from PTFE.

FIG. 2 furthermore shows the bearing devices 30 and 30' which are arranged in the region of the struts 46 and 46', are provided for the seat carrier and backrest carrier 1 and 2, are formed from the parts 32, 33, 34 and 32', 33', 34' and are mounted on the bushings 44 and 28 by means of correspondingly designed bearing bodies 31 and 31'. At a distance from the axis X, a correspondingly designed tab 47, 47' is arranged and fastened on each strut 46, 46'. The first and second lever systems 50, 50', operatively connected to the locking device 65, are mounted on the tabs 47, 47'.

In the following, one lever system 50 and the locking device 65, operatively connected thereto, of the first exemplary embodiment are described in detail by means of FIGS. 1 and 2:

The lever system 50 comprises a first toggle-lever pair 51, 52 which is mounted, by means of a first bolt 48, on the tab 47 fastened on the strut 46. On a second bolt 49, a second toggle-lever pair 53, 54 is arranged on the first toggle-lever pair 51, 52. Via a third bolt 56, the second toggle-lever pair 53, 54 is mounted on a tab 57 of a sliding piece 60 arranged at the front end of the strut 46. The sliding piece 60 is, as shown in FIG. 1, arranged in a slot 63 of the strut 46 and is displaceably guided in the strut 46 in the longitudinal direction designated by the double arrow Y, Y'. The sliding piece 60 is held on the strut 46 by means of two correspondingly designed guiding pieces 61, 62 which are held together by screw connections (not shown).

FIG. 1 shows a partial view of the above-described lever system 50 with the individual parts 48, 49, 51, 52, 55 and 56.

The first toggle-lever pair 51, 52 of the first lever system 50 is further, as shown in FIG. 2, operatively connected to one end of a spring element designed as a pneumatic spring 64. The pneumatic spring 64 has a piston rod 66 and a fastening tab 67 which is arranged thereon at the front end and by means of which the pneumatic spring 64 is operatively connected via a fourth bolt 55 to the first toggle-lever pair 51, 52. At the other end, the pneumatic spring 64 is operatively connected via an actuating device, designated as a whole by 70, to the bolt 55' of the opposite toggle-lever pair 51', 52' of the second lever system 50'.

The second lever system 50', arranged correspondingly to the first lever system 50, with the parts 47'; 48'; 49'; 51'; 52'; 53'; 54'; 55' and 56' is designed analogously to the first lever system 50. In this arrangement, one toggle-lever pair 51'; 52' is operatively connected via a bolt 55' to the actuating device 70. The other toggle-lever pair 53'; 54' is connected via a bolt 56' to the tab 57' of the sliding piece 60'.

The two lever systems 50; 50', operatively connected to the pneumatic spring 64, and the sliding pieces 60; 60', which are operatively connected thereto and arranged such that they can be displaced on the struts 46; 46' in the arrow direction Y; Y', and bearing pins 58; 58' arranged thereon are designed mirror-invertedly and analogously to one another. The two bearing pins 58; 58' are provided for receiving the second bearing device 75, 75' (FIGS. 1 and 3) for the seat carrier 1. The two bearing pins 58; 58' essentially form the second articulation point 4, 4'. On each of the two bearing pins 58, 58' there is further arranged a bearing block 76, 76' which is designed for fastening the seat carrier 1, a profile body connecting piece 77 (partially shown) being arranged for stabilising purposes between the two bearing blocks 76, 76' and being fastened on the bearing blocks 76, 76' in a manner which is not shown.

The actuating device 70, shown in FIG. 2, for the locking device 65 comprises a tubular intermediate piece 72 which is arranged with one end on the pneumatic spring 64 and with the other end on a connecting piece 69. The connecting piece 69 is operatively connected by the bolt 55' to the associated second lever system 50'. A tab 71 and a lever 74, passing through the tubular intermediate piece 72 in the radial direction, are arranged on the said intermediate piece 72. On a bearing piece 73 arranged on the intermediate piece 72, the lever 74 can be pivoted relative to the tab 71 in the arrow direction 74'. For releasing or locking the pneumatic spring 64, the push rod 68 of the pneumatic spring 64 is actuated by the lever 74 which can be pivoted by actuating elements (handle and Bowden cable) (not shown).

Figure 3:
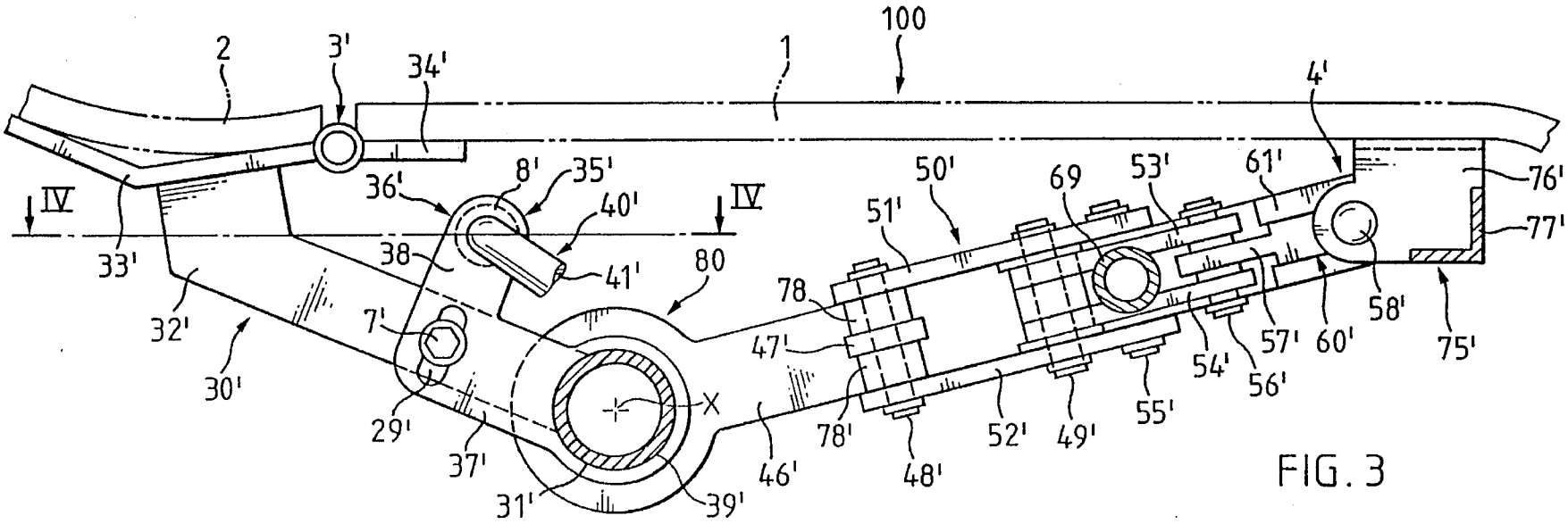
FIG. 3 shows the load-bearing frame according to FIG. 1, represented in sectional view corresponding to the line III—III drawn in FIG. 2.

FIG. 3 shows the load-bearing frame 100, represented in sectional view corresponding to the line III—III drawn in FIG. 2, with the load-bearing and pivoting device 80 of the first exemplary embodiment, and the seat carrier 1, the backrest carrier 2 operatively connected thereto via the articulation point 3', the bearing device 30' and the retaining device 35' for the helical spring 40' operatively connected thereto are shown. The bearing device 30' comprises the two fastening tabs 33', 34' and the lever 32' which is arranged and fastened on the tab 33' and on the bearing body 31'. The retaining device 35' has a toggle lever 36' on which a tubular piece 8' is arranged on one lever part 38' and a bearing piece 39' is arranged on the other lever part 37'. By means of the formed-on bearing piece 39', the toggle lever 36' is mounted on the bearing body 31' such that it can pivot about the horizontal axis X. One lever part 38' of the toggle lever 36' is provided with a slot 29' and, in the upper region, with the tubular piece 8' into which one end 41' of the helical spring 40' is plugged. The toggle lever 36' is operatively connected to the lever 32' of the bearing device 30' by means of a screw connection 7' passing through the slot 29'.

FIG. 3 further shows a view of one lever system 50', and the tab 47', arranged on the strut 46', and the first toggle-lever pair 51', 52', spaced apart by intermediate pieces 78, 78' in the form of bushings and mounted on the bolt 48', are shown. Spaced apart therefrom, the second toggle-lever pair 53', 54' mounted on the bolt 49' is arranged between the first toggle-lever pair 51', 52'. Further shown are the connecting piece 69, operatively connected to the toggle-lever pair 51', 52' by means of the bolt 55', of the locking device (FIG. 2), the sliding piece 60' operatively connected to the toggle levers 53', 54' and the bolt 56', and one bearing block 76', arranged on the pin 58', for receiving and fastening the seat carrier 1. The two bearing blocks 76, 76' arranged in mutual correspondence are operatively connected to each other by the connecting piece 77 designed as an angle profile in FIG. 3.

Figure 4:
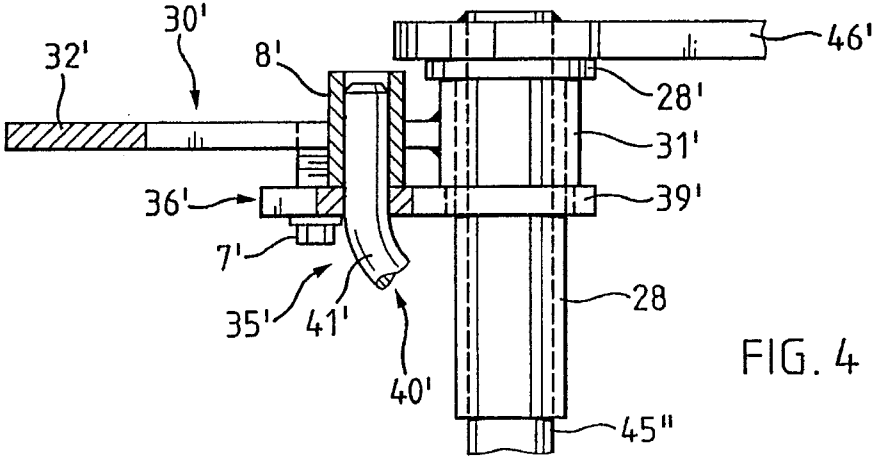
FIG. 4 shows a part-piece of the load-bearing frame according to FIG. 1 partially in section and in plan view corresponding to the line IV—IV drawn in FIG. 3.

FIG. 4 shows a plan view corresponding to the line IV—IV in FIG. 3 of one retaining device 35' which is shown partially in section and is operatively connected to the lever 32' of the bearing device 30' by means of the fastening screw 7'. Further shown are the guiding bushing 28, arranged on one spindle body 45" and bearing with the collar 28' on the strut 46', and the bearing body 31' with the lever 32' fastened thereon. At a distance from the lever 32' there is arranged the toggle lever 36' mounted by the part 39' on the part 31', the tubular piece 8' designed for receiving the end piece 41' of the helical spring 40' (FIG. 2) being fastened on the toggle lever 36'. The toggle lever 36' provided with the slot 29' can be adjusted relative to the lever 32' of the bearing device 30' and can be fastened in the required position by the fastening screw 7' (fixing).

At this stage it is pointed out that the two bearing devices 30 and 30' and the two retaining devices 35 and 35' and the two lever systems 50 and 50' are in each case designed analogously.

Figure 5:
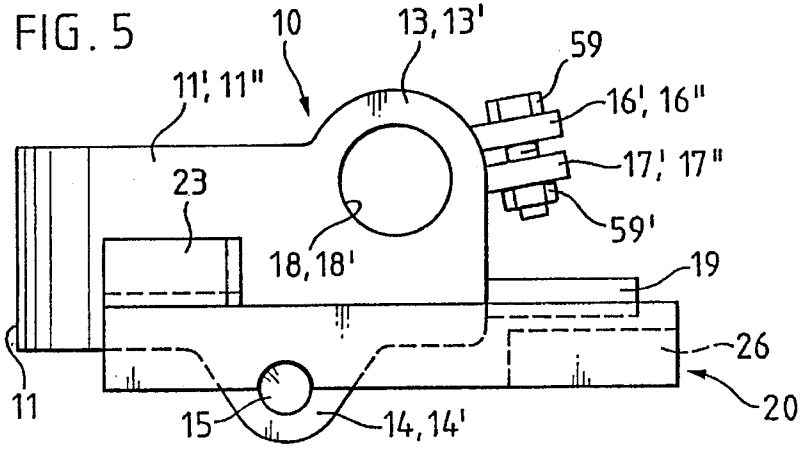
FIG. 5 shows a view of a retaining device for the load-bearing frame according to FIG. 1 fastened on the standing column, and a bracing element arranged thereon.
Figure 6:
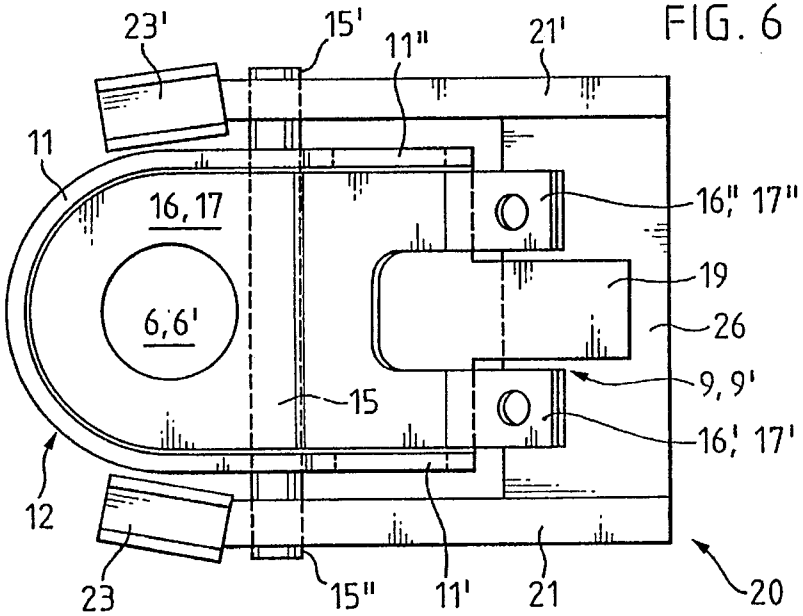
FIG. 6 shows a plan view of the retaining device with the bracing element arranged thereon.

In FIG. 5, as a first exemplary embodiment, a view is shown of the retaining device 10 and the bracing element 20, mounted thereon, for the load-bearing frame 100, and in FIG. 6 they are shown in plan view. The retaining device 10 comprises a retaining piece 12 provided with a back wall 11 and two side walls 11', 11" arranged thereon, two intermediate pieces 16 and 17 for receiving the standing column 5 and provided with bores 6 and 6', and a stop piece 19. As shown in FIG. 6, the two intermediate pieces 16, 17 are each subdivided in the front region by a cutout 9 and 9' into part-pieces 16', 16" and 17', 17". The back wall 11, on which the side walls 11' and 11" are integrally formed, is designed preferably in an arcuate manner (FIG. 6). On the two side walls 11' and 11" there is in each case integrally formed in the lower region an arched piece 14, 14' through which the bearing bolt 15 passes. In the upper region of the side walls 11' and 11" there is in each case formed an arched piece 13, 13' in which there is an opening 18, 18'. The openings 18 and 18' are designed for receiving the spindle bodies 45', 45", preferably in a positively locking manner. The spindle bodies 45', 45" designed preferably as hollow bodies may have, for example, a profile cross-section designed as a polygonal tube, the openings 18, 18' in the side walls 11 and 11' being correspondingly adapted to the said profile cross-section.

Further shown is the bracing element 20 which is mounted by two side parts 21 and 21', as shown in FIG. 6, on the two laterally projecting end pieces 15' and 15" of the bearing bolt 15. In the front region of the bracing element 20 there is arranged and fastened on each side part 21, 21' the essentially shoe-shaped retaining piece 23, 23' for the end pieces 42, 42' of the helical springs 40, 40' (FIG. 2). At the other end there is arranged and fastened between the two side parts 21, 21' a connecting web 26 for receiving the threaded spindle 24 (FIG. 1).

Figure 7:
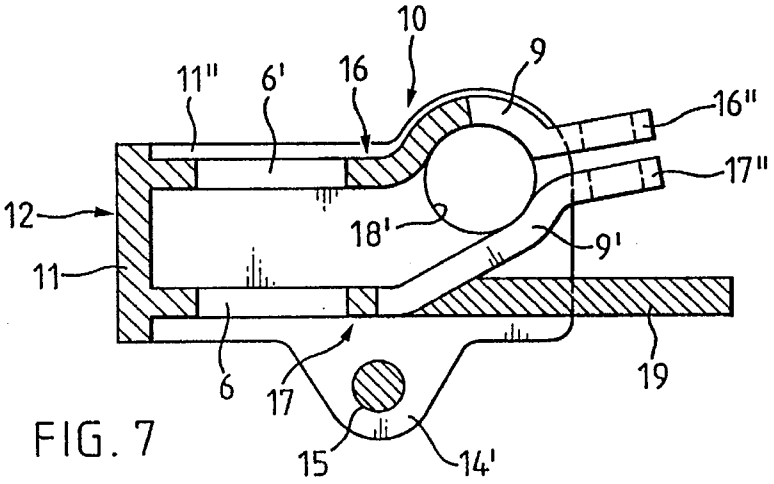
FIG. 7 shows a sectional view of the retaining device according to FIG. 5.

FIG. 7 shows a sectional view of the retaining device 10, and the retaining piece 12 with the back wall 11 and one side wall 11" are shown. On the back wall 11, the two intermediate pieces 16 and 17 provided with the bores 6, 6' are arranged, preferably integrally formed on the said back wall 11. In the front region, the intermediate pieces 16, 17 separated by the gap 9, 9' are designed in a manner corresponding to the shaping of the spindle bodies 45 and 45' plugged into the openings 18, 18'. The correspondingly arranged and spaced-apart end pieces 16', 17' and 16", 17" which, in the assembled state, engage about the spindle bodies 45', 45" are, as shown in FIG. 5, in each case pressed and held together by means of a screw connection 59, 59' or the like. Further shown are the stop piece 19, arranged between the side walls 11' and 11" and fastened in a manner which is not shown, and the bearing bolt 15 for the bracing device 20.

Figure 8:
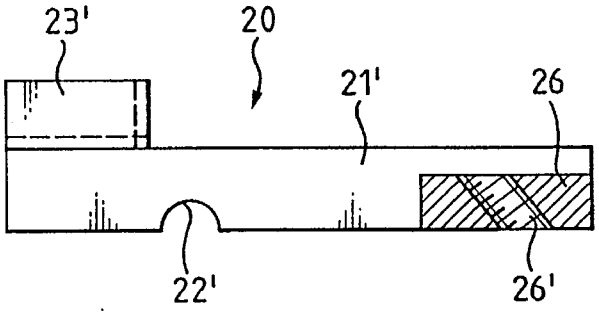
FIG. 8 shows a sectional view of the bracing element for the retaining device according to FIG. 6.

FIG. 8 shows the bracing device 20, partially in section, and reveals one side part 21' provided with a cutout 22' for the bearing bolt 15, the connecting web 26 having a threaded bore 26' for the threaded spindle 24 (FIG. 1 ), and the retaining piece 23' which is fastened in the front region on the side part 21' and is intended for the end piece 42' of the helical spring 40' (FIG. 2). The opposite side part 21 with the retaining part 23 is, as shown in FIG. 6, designed analogously to the side part 21'.

The above-described load-bearing frame 100 ensures the precise transmission of the pivoting movement, inter alia also dependent on the body weight of the user, to the spring elements. In this arrangement, the restoring force of the two helical springs 40, 40' can be adjusted relatively easily to the body weight of the user. The movements are transmitted in a rectilinear manner to the pneumatic spring 64 via the lever system 50, 50', as a result of which the seals in the pneumatic spring are subjected to a substantially smaller and more uniform load.

Figure 9:
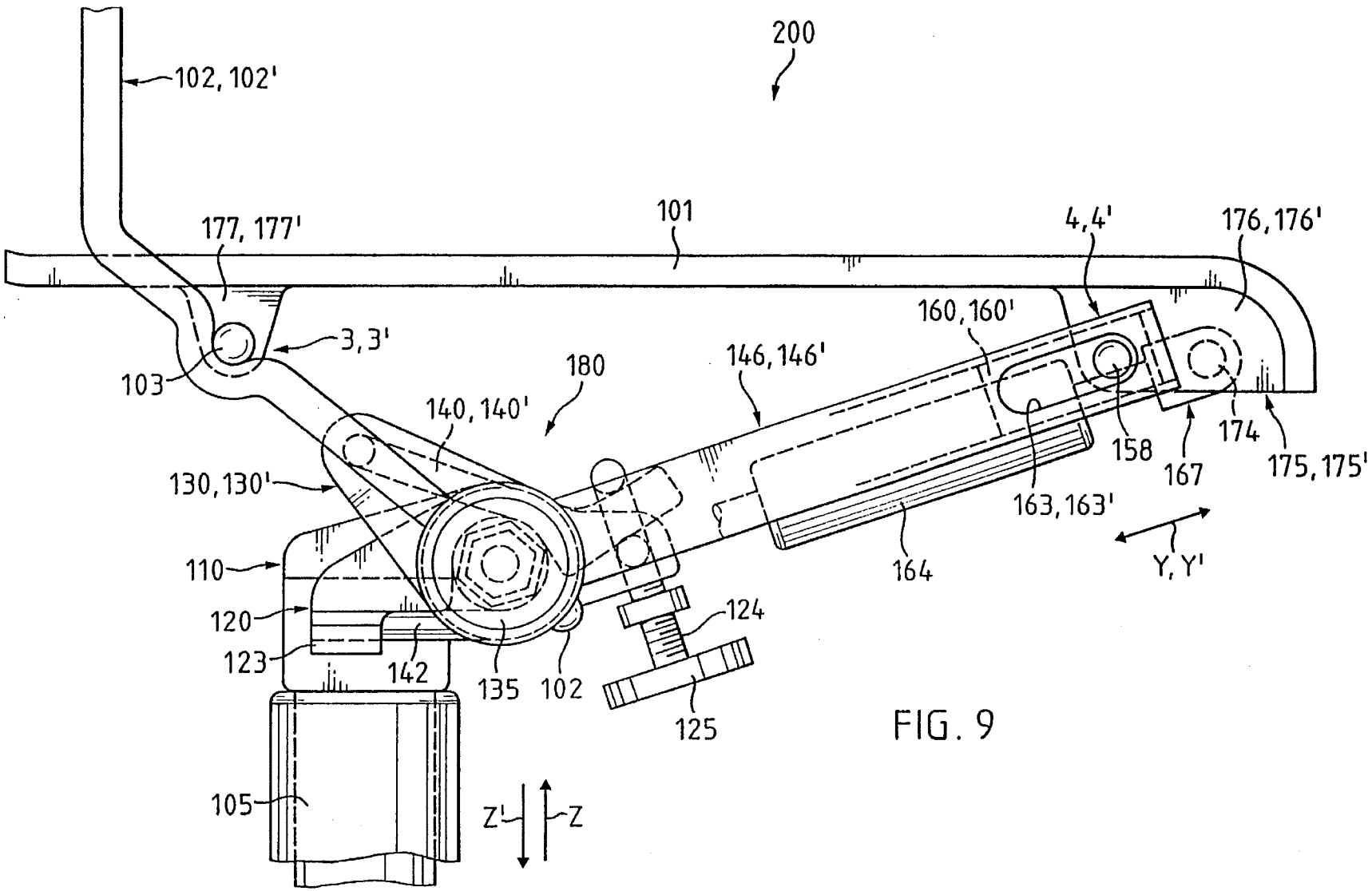
FIG. 9 shows a side view of the second exemplary embodiment of the load-bearing frame, arranged on a standing column, for an office chair.

FIG. 9 shows, as a second exemplary embodiment, a load-bearing frame 200 for an office chair which can be adjusted in terms of its height and inclination and is not shown in any more detail. The load-bearing frame 200 comprises a load-bearing and pivoting device 180 on which are mounted two backrest carriers 102, 102', arranged in the axial direction of the load-bearing and pivoting device 180 and at a distance from each other, and two struts 146, 146'. At the knee-side end of the struts 146, 146', there are provided correspondingly designed articulation points 4, 4' for mounting a seat carrier 101. At the backrest-side end, the seat carrier 101 provided with bearing blocks 177, 177' is mounted on a connecting piece 103 which passes through the bearing blocks 177, 177'. The part 103 connecting the two backrest carriers 102, 102' to each other and having the two bearing blocks 177, 177' forms, for example, the backrest-side articulation points 3, 3'.

The load-bearing and pivoting device 180 operatively connected to two spring elements 140, 140' arranged transversely to the seat direction is arranged and fastened on a standing column 105, which is shown schematically and only partially, by means of a retaining device 110 which is designed, for example, as a housing. The restoring force of the two spring elements 140, 140' retained by one end in a bearing part 130, 130' can be adjusted via a bracing element 120 which is supported on the retaining device 110 and is operatively connected to a threaded spindle 124 and a hand wheel 125. The standing column 105 is designed essentially analogously to the standing column 5 described above in conjunction with FIG. 1 and can be adjusted in terms of its height in arrow direction Z and Z' by means of a spring element (pneumatic spring) (not shown).

Figure 10:
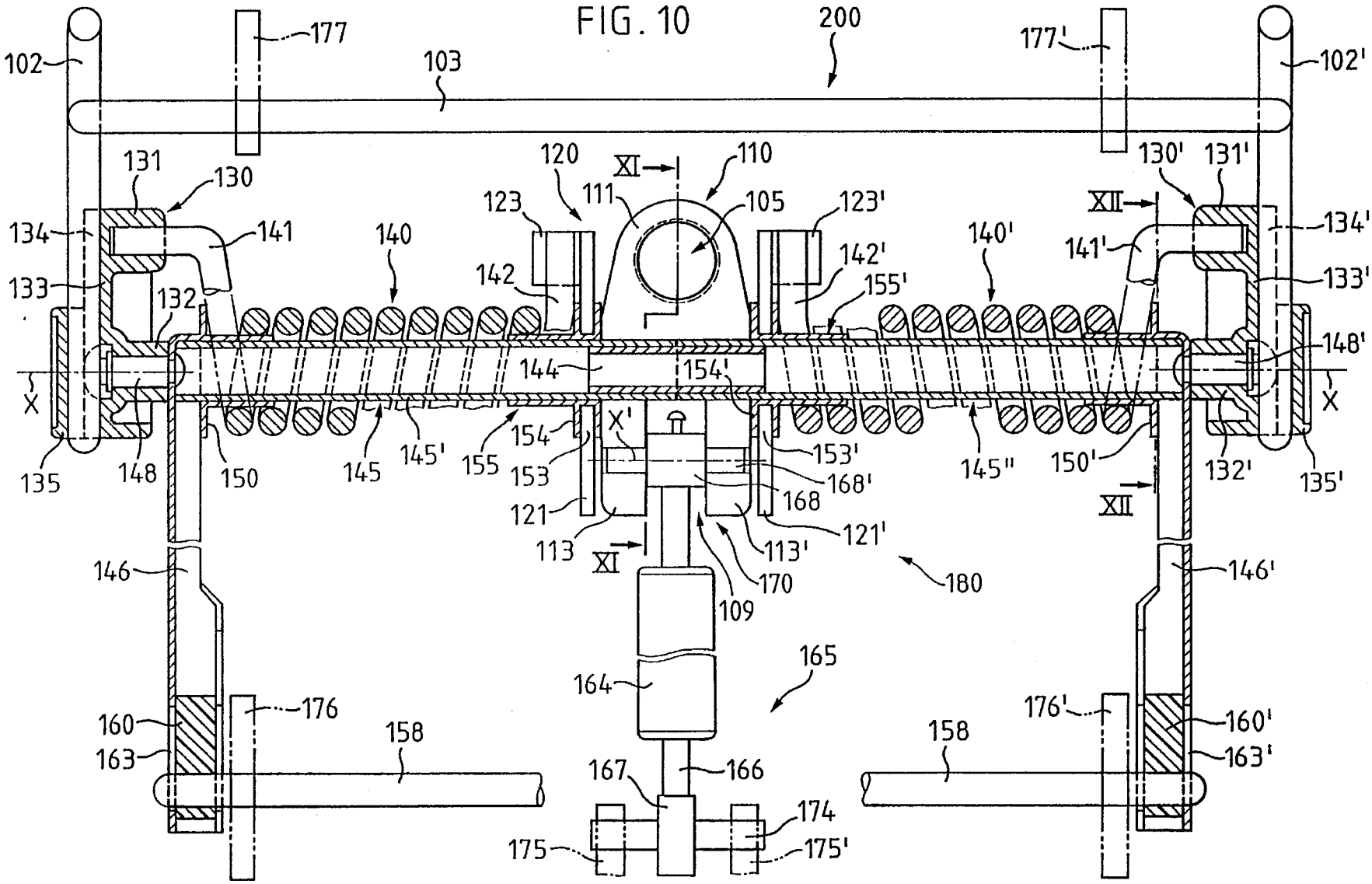
FIG. 10 shows the load-bearing frame according to FIG. 9 in plan view and partially in section.

Further shown in FIG. 9 is a spring element 164 which is designed as a pneumatic spring and is mounted in the knee-side region, by means of a fastening tab 167 and a bearing bolt 174, on two spaced-apart bearing blocks 175, 175' arranged on the underside of the seat carrier 102 (FIG. 10). The spring element 164 is mounted, by the other end, on the retaining device 110, as will be further described later in conjunction with FIGS. 10 and 11. On the underside of the seat carrier 102 there are further provided two spaced-apart bearing blocks 176, 176' on which the struts 146, 146', operatively connected to each other via a connecting piece 158, are mounted. The connecting piece 158 essentially forms the knee-side articulation point 4, 4', the bolt-shaped connecting piece 158 together with the two sliding pieces 160, 160' each being displaceably guided in the struts 146, 146' which are designed in an approximate [-shape in profile cross-section and are each provided with a cutout 163, 163' designed as a slot. The pushing movement oriented in arrow direction Y or Y' occurs during the pivoting movement of the parts 101 and 102.

Figure 11:
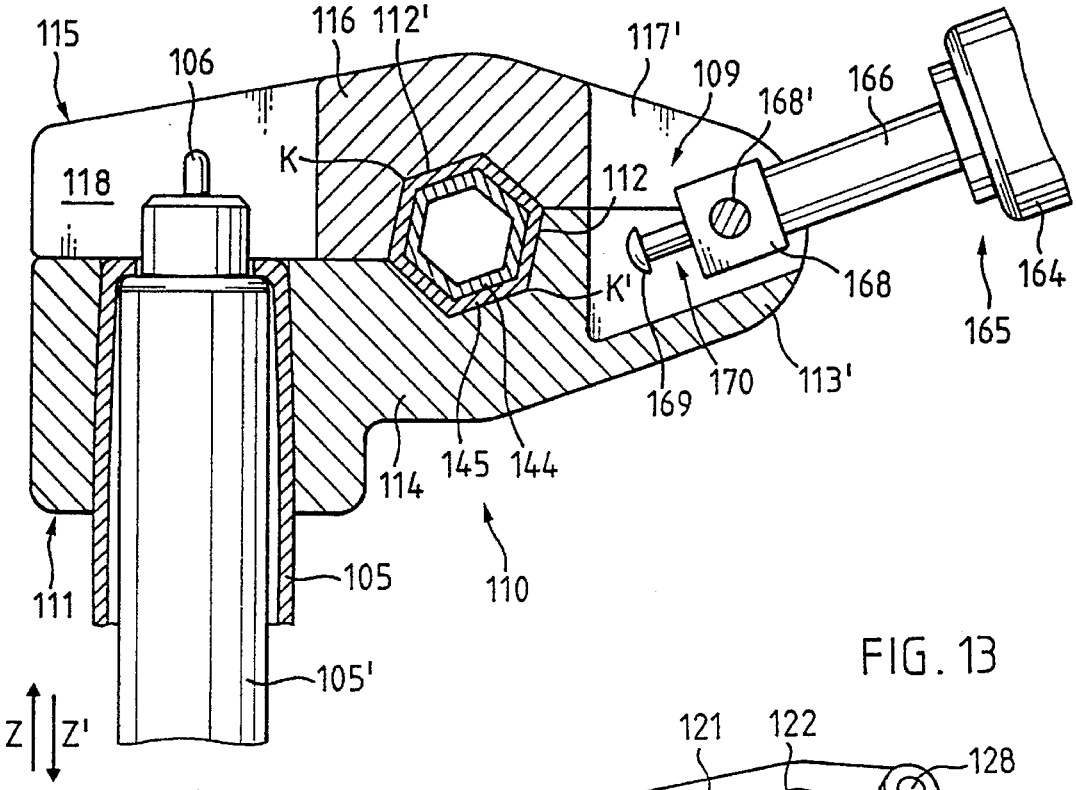
FIG. 11 shows a part-piece, represented in sectional view according to the line XI—XI drawn in FIG. 10, of the load-bearing frame according to FIG. 9 fastened on the standing column by means of a retaining device.

In FIG. 10, the load-bearing frame 200 of the second exemplary embodiment (without seat carrier and backrest carrier 101, 102) with the load-bearing and pivoting device 180 is shown in plan view and the retaining device 110, arranged on the schematically represented standing column 105, and the bracing device 120 are shown. A spindle body 145 essentially forming the horizontal axis X is arranged in the retaining device 110. The spindle body 145 is subdivided, for example, into two part-pieces 145' and 145" which are operatively connected to each other in the region of the retaining device 110 by a coupling or connecting piece 144. The spindle body 145 or the two part-pieces 145', 145" comprise, for example, a hollow body which is polygonal in profile cross-section (FIG. 11). The struts 146 and 146' are respectively arranged and fastened at the outer ends of the spindle bodies 145', 145". The retaining device 110with the two spindle bodies 145' and 145" and the two struts 146 and 146' are connected to one another such that they are fixed in terms of rotation, in a manner not shown in any more detail, and together form a structural unit.

Between the retaining device 110 and the two struts 146, 146' arranged at a distance therefrom there are arranged the two helical springs 140, 140', through each of which the associated spindle-body part-piece 145' and 145" passes and which are mounted on bushings 150, 155 and 150', 155' arranged at a distance from one another. The bushings 150, 155 and 150', 155' each have a formed-on flange bearing on the two side walls of the retaining device 110 and on the struts 146, 146'. The flanges, designated by 154, 154', of the two bushes 155 and 155' are each provided with a circular peripheral groove 153, 153'. The bracing device 120 is mounted, with two side parts 121, 121', in the grooves 153, 153' such that it can pivot about the axis X—X of the spindle-body part-pieces 145', 145".

The bushings 150, 150' and 155, 155' provided for mounting the helical springs 140, 140' and the clamping device 120 are produced preferably from suitable plastic with good sliding properties, for example from PTFE.

FIG. 10 furthermore shows the bearing elements 130, 130' which are arranged in the region of the two struts 146, 146', and are provided in each case with a first hub piece 131, 131' for the associated spring end piece 141, 141' and in each case with a second hub piece 132, 132' and a back wall 133, 133' connecting the hub pieces to one another. The individual bearing elements 130, 130' are fastened on the associated struts 146, 146' by means of fastening elements 148, 148' (rivet or screw connection) passing through the second hub pieces 132, 132'. On the side directed towards the backrest carriers 102, 102' there is provided a cutout (not shown in any more detail) which is delimited by side walls 134, 134' and is intended for the respective backrest carriers 102, 102', the individual backrest carriers 102, 102' being fastened and held on the bearing elements 130, 130' by correspondingly designed retaining pieces 135, 135' and means (screw connection) (not shown).

FIG. 10 furthermore shows the connecting piece 103 which is arranged in the spaced-apart and schematically represented bearing blocks 177, 177' and by means of which the two backrest carriers 102, 102' are connected to each other in the backrest-side region. In the knee-side region, the two struts 146, 146' are operatively connected to each other by the connecting piece 158 arranged in the bearing blocks 176, 176'. The rod-shaped connecting piece 158 is displaceably guided in the struts 146, 146', provided with corresponding cutouts 163, 163', by sliding pieces 160, 160' arranged at the ends.

FIG. 10 further shows the spring element 164 which is mounted by a bearing piece 168 in the retaining device 110 such that it can pivot about the axis X' of a bolt 168' and which can be released and locked by an actuating device 170 which is not shown in any more detail. The spring element 164 and the actuating device 170 together form a so-called locking device 165 known per se. In the knee-side region, the piston rod 166 with the fastening tab 167, which is held by means of the bearing bolt 174 on the two spaced-apart bearing blocks 175, 175', is also shown.

FIG. 11 shows a sectional view of the retaining device 110 according to the line XI—XI in FIG. 10, the locking device 165 with the pneumatic spring 164 arranged thereon, and a part-piece of the standing column 105 provided with a pneumatic spring 105'. The retaining device 110 has a housing 111 with housing cover 115. The parts 111 and 115 are connected to each other by corresponding fastening screws (not shown). The standing column 105 is arranged in a bore (not shown) of the housing 111 such that the push rod 106, projecting into a cutout 118 of the housing cover 115, of the pneumatic spring 105' is easily accessible for arranging an actuating device (not shown). The housing 111 has a first head piece, designated as a whole by 114, which is designed with a cutout 112 for mounting the spindle body 145. The housing cover 115 has a second head piece, designated as a whole by 116, which is designed with a cutout 112' for mounting the spindle body 145.

The two cutouts 112, 112' arranged in mutual correspondence in the head pieces 114 and 116 form a cutout which is oriented in the longitudinal direction of the spindle body 145, is correspondingly adapted to the outer contour of the spindle body 145 and, in the assembled state of the parts 111 and 115, engages in a positively locking manner about the spindle body 145. The spindle body formed from the two parts 145', 145" is, for example, a hollow profile body which is polygonal in profile cross-section, preferably a hexagonal hollow profile body. The connecting piece 144 by means of which the two spindle-body parts 145' and 145" are connected to each other in a coupling-type manner is preferably also designed as a polygonal hollow profile body.

In the two head pieces 114, 116 there is provided in the front region a cutout, designated as a whole by 109, which is delimited by side walls 113, 113' and 117, 117'. In the recess 109, a bearing piece 168, operatively connected to the piston rod 166 of the pneumatic spring 164, is arranged and mounted in the side walls by means of a bolt 168'.

Figure 12:
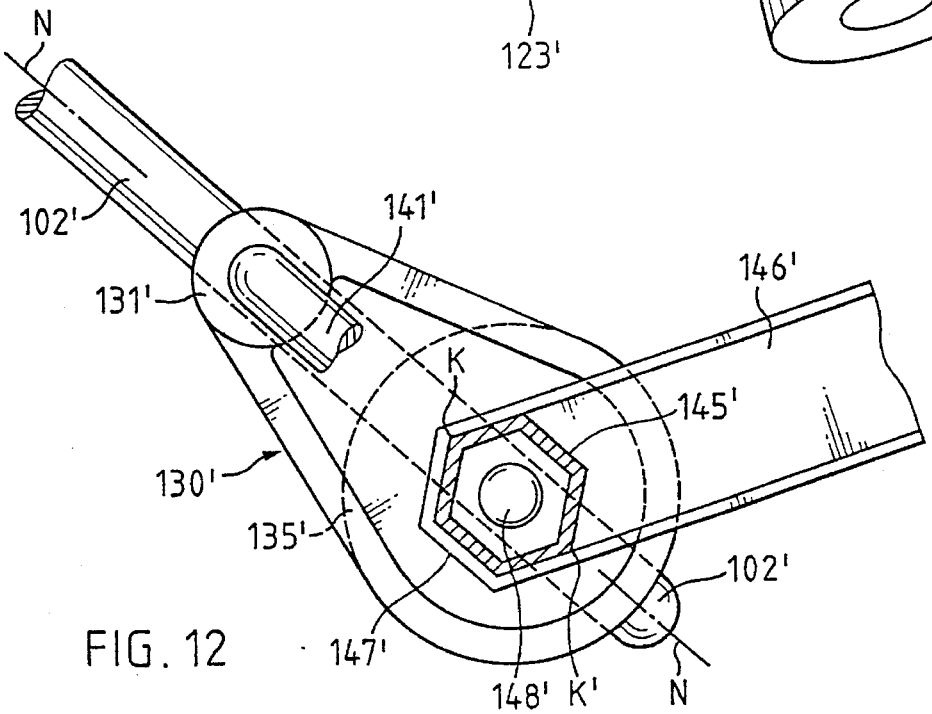
FIG. 12 shows a sectional view of a part-piece of the load-bearing frame according to the line XII—XII in FIG. 10.

FIG. 12 shows a sectional view of a part-piece of the load-bearing frame according to the line XII—XII in FIG. 10, and the strut 146' which is arranged on the spindle body 145' and, at its end piece 147', is adapted analogously to the spindle body 145' designed as a hexagonal hollow profile body in profile cross-section. The end piece 147' of the strut 146' engages about the spindle body 145 in a positively locking manner. Further shown are the bearing part 130', which is operatively connected to the strut 146' by the rivet or screw connect ion 148' and has the end piece 141' mounted thereon and the helical screw 140' (FIG. 10), and one backrest carrier 102'.

Figure 13:
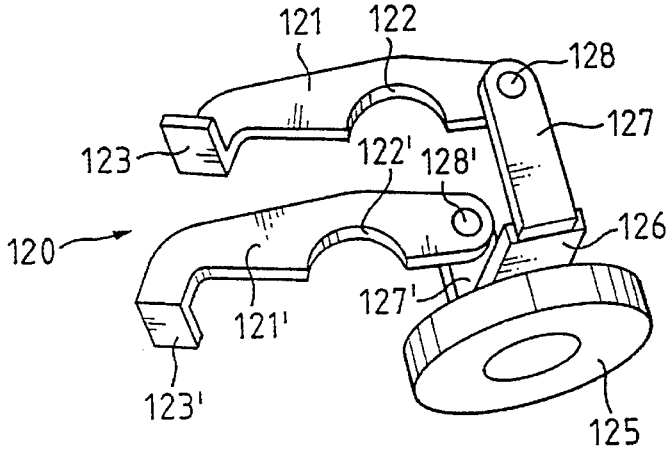
FIG. 13 shows a perspective view of a bracing element for the retaining device arranged on the chair frame in accordance with the second variant.

FIG. 13 shows a perspective view of the bracing element 120 for the two helical screws 140 and 140', which bracing element essentially comprises a connecting web 126, with two tabs 127, 127' arranged laterally thereon, and a hand wheel 125 which is in engagement with the threaded spindle 124 (FIG. 9) (not shown here). On the two tabs 127, 127', the side parts 121, 121' are each mounted such that they can pivot about bearing bolts 128, 128'. The side parts 121, 121' are each provided with an arcuate cutout 122, 122'. The cutouts 122, 122' are correspondingly adapted to the inner diameter of the grooves 153, 153' (FIG. 10) provided in the bushings 155, 155'. At the front end, in each case an outwardly bent retaining piece 123, 123' is integrally formed on, which retaining pieces serve in each case as counter-bearing for the end pieces 142 and 142' of the two helical springs 140, 140' (FIG. 10).

At this stage it is pointed out that the spindle-body part-pieces 145', 145", arranged in the retaining device 110, operatively connected in a positively locking manner to the struts 146 and 146' and designed hexagonally, are arranged such that the two corresponding edges K, K' form, as shown schematically in FIG. 12, an axis N—N for the inclined position of the backrest carriers 102, 102'.

In the case of the load-bearing frame 100 or 200, for releasing or fixing the individual elements, the pneumatic springs arranged in the standing column 5 or 105 and pneumatic spring 64 or 164 arranged in the seat direction or transversely thereto are operatively connected to an actuating device (not shown) via Bowden cable elements. In this arrangement, the Bowden cable elements (not shown) are advantageously passed through the spindle body 45 or 145 designed as a hollow profile body or through one or both spindle-body part-pieces.

The above-described load-bearing frame 200 likewise ensures a precise transmission of the pivoting movement, inter alia also dependent on the body weight of the user, to the spring elements. In this arrangement, the restoring force of the two helical springs 140, 140' can be adjusted relatively easily to the body weight of the user. The movements of the seat carrier and backrest carrier are transmitted in a rectilinear manner to the pneumatic spring 164, with the result that the seals in the pneumatic spring are subjected to a substantially smaller and more uniform load.

I claim:

1. Load-bearing frame for a chair which can be adjusted in terms of its height and inclination, comprising:

a standing column, a load-bearing and pivoting device arranged on said standing column, a seat carrier and a backrest carrier, the seat carrier and the backrest carrier being mounted on the load-bearing and pivoting device by means of two lateral struts arranged on a knee side of a spindle body, said carriers being pivotable about a horizontal axis of the load-bearing and pivoting device against the restoring force of at least one first, spring element, said carriers being lockable in any position and being releasable again by a second spring element, the load-bearing frame further comprising a retaining device, which is arranged at the upper end of the standing column and through which the spindle body passes, and said first spring element including two helical springs which are oriented in the longitudinal direction of said horizontal axis, said springs being arranged between the lateral struts and the retaining device, said springs being mounted on the spindle body and, in order to adjust spring restoring force each being held at a respective one end by a respective spring end piece on a bracing element mounted on the retaining device and, at a respective other end on a bearing element which is operatively connected to the backrest carrier, a knee side of the seat carrier being slidably and pivotably mounted on the struts arranged on the knee side of the spindle body by means of respective second bearing devices, each provided with a bearing pin, which is displaceably guided in a respective said strut, in order to maintain the knee side of the seat carrier at substantially a given height when a user pivots the chair about said horizontal axis.

2. A load-bearing frame according to claim 1, wherein:

each bracing element is pivotal by means of two spaced-apart side parts about a bolt, arranged on the retaining device and oriented so as to be parallel to said horizontal axis, and is adjustable relative to the retaining device by means of a threaded spindle provided with a handle.

3. A load-bearing frame according to claim 1, wherein:

said second spring element comprises a pneumatic spring arranged parallel to and at a distance from the spindle body between said struts and being operatively connected, via associated lever systems and sliding pieces arranged thereon, to said struts such that, when a valve of said second spring element is open, said second spring element can be adjusted relative to and parallel to the spindle body during the adjustment movement of the backrest carrier and seat carrier.

4. A load-bearing frame according to claim 1, wherein:

the second spring element comprises a pneumatic spring arranged transversely to the spindle body and pivotably mounted, by one end thereof, in the retaining device, and, by another knee-side end thereof, on the seat carrier.

5. A load-bearing frame according to claim 1, wherein:

the spindle body is a hollow body with a polygonal cross-sectional profile.

6. A load-bearing frame according to claim 1, wherein:

a cutout penetrates the retaining device, said cutout corresponding in profile to the cross-sectional profile of the spindle body in order to achieve a locking connection.

7. A load-bearing frame according to claim 1, wherein:

said two struts have respective ends assigned to the spindle-body these ends each having a polygonal cross section and these ends being lockingly connected to the spindle-body.

8. A load-bearing frame according to claim 1, wherein:

for releasing and fixing, a pneumatic spring is arranged in the standing column and operatively connected to an actuating device via mechanical control connections, and the mechanical control connections are passed through the spindle body.

9. A load-bearing frame according to claim 1, wherein:

the spindle body is subdivided into two spindle-body part-pieces, each of which at a respective one end is operatively connected to a respective said strut and, at a respective other end, is secured to the retaining device such that said spindle body part-pieces are locked against rotation.

10. A load-bearing frame according to claim 9, wherein:

the spindle-body part pieces are hollow bodies with hexagonal cross-sectional profiles and are connected to one another by a hexagonal coupling piece.

11. A load-bearing frame according to claim 1, wherein:

the two helical springs are mounted, at least at respective ends, on plastic bushings, the plastic bushings, for pushing onto the spindle bodies, having cutouts conforming to the outer profile of the spindle body.

12. A load-bearing frame according to claim 11, wherein:

the bracing element has two side parts each provided with an arcuate cutout and is pivotally mounted, by the two side parts, in a peripheral groove of a respective said plastic bushing, each said plastic bushing being provided with a flange.

13. A load-bearing frame according to claim 1, wherein:

a cutout having a hexagonal cross-sectional profile passes through the retaining device which comprises two parts a housing and a housing cover, which cutout is arranged and designed such that two corresponding edges of the hexagonal profile form a boundary surface between the housing and the housing cover.

14. A load-bearing frame according to claim 13, wherein:

the spindle-body is held in a locking condition in the retaining device and in the struts, said spindle-body being hexagonal and being comprised of pieces having corresponding edges which define an axis corresponding to the position of the backrest carrier when the backrest carrier is inclined backwards.

15. A load-bearing frame according to claim 14, wherein:

the backrest carrier in the backwards-inclined position are fastened on the bearing element, the bearing element being provided with a cutout corresponding in profile to the cross-sectional profile of the backrest carrier.

* * * * *